US005367772A

United States Patent [19]

Ogawa

[11] Patent Number: 5,367,772

[45] Date of Patent: Nov. 29, 1994

[54] HAIR CLIPPER

[75] Inventor: Hitoshi Ogawa, Hikone, Japan

[73] Assignee: Matsushita Electric Works, Ltd., Osaka, Japan

[21] Appl. No.: 64,684

[22] Filed: May 20, 1993

[30] Foreign Application Priority Data

May 26, 1992 [JP] Japan ..... 4-133021
Jun. 25, 1992 [JP] Japan ..... 4-166581

[51] Int. Cl.[5] ..... B26B 19/20
[52] U.S. Cl. ..... 30/201; 30/233
[58] Field of Search ..... 30/196, 200, 201, 202, 30/233, 233.5, 43, 43.1, 43.2, 208

[56] References Cited

U.S. PATENT DOCUMENTS

| | | | |
|---|---|---|---|
| 1,774,046 | 8/1930 | Wahl | 30/201 |
| 1,877,749 | 9/1932 | Andis | 30/201 |
| 4,776,095 | 10/1988 | Tsujimoto et al. | 30/201 |
| 4,845,852 | 7/1989 | Sukow | 30/201 |
| 4,949,460 | 8/1990 | Sterk | 30/201 |
| 5,054,199 | 10/1991 | Ogawa et al. | 30/200 |

FOREIGN PATENT DOCUMENTS

| | | |
|---|---|---|
| 1090544 | 10/1960 | Germany . |
| 4119713 | 1/1992 | Germany . |
| 2245518 | 1/1992 | United Kingdom . |
| 2245518A | 1/1992 | United Kingdom . |

*Primary Examiner*—Richard K. Seidel
*Assistant Examiner*—Hwei-Siu Payer
*Attorney, Agent, or Firm*—Kenyon & Kenyon

[57] ABSTRACT

A hair clipper has a cutter head on the front end of a housing. The cutter head includes a toothed stationary blade and a toothed movable blade reciprocating on the stationary blade in a hair shearing engagement between individual toothed edges thereof. The movable blade is slidable relative to the stationary blade in an edgewise direction perpendicular to the reciprocating motion of the movable blade for varying a cut length of hairs. An adjuster handle is slidably fitted on an outer round surface of the housing and linked to the movable blade through a linkage member such that the movable blade is shifted in the edgewise direction to increase and reduce the cut length by rotating the adjuster handle about a longitudinal axis of the housing. In addition, the hair clipper can be formed in such a structure that the reciprocating motion of the movable blade is turned on and off at the opposite ends of the rotation range of the adjuster handle. Therefore, the operator is required only to rotate the adjuster handle with a slight manipulation force for initiating the reciprocating motion and then adjusting the cut length.

6 Claims, 12 Drawing Sheets

100B
16B
17B
12B
70B
85B
72B
71B
83B
80B
82B
81B
82B
84B
92B
30B
90B
91B
13B
32B
31B
33B
11B
18B
60B

HAIR CLIPPER

BACKGROUND OF THE INVENTION

1. Field of the Invention

The present invention is directed to a hair clipper, and more particularly to an improved hair clipper capable of facilitating to cut hairs to any desired cut length without causing uneven hair cuts with a minimum manipulation force of adjusting the cut length.

2. Description of the Prior Art

A hair clipper with varying cut length capability has been described in U.K. Patent Application. No. 2 245 518A (U.S. patent application No. 712,097 now U.S. Pat. No. 5,325,589 in which a movable blade is moved relative to a stationary blade for varying a cut length of hairs by moving an adjuster handle mounted on a housing of the hair clipper in a direction along the longitudinal axis of the housing. The movable blade is interlocked with the adjuster handle through a linkage member in such a manner that the movable blade is moved in a rearward direction along the longitudinal axis to reduce the cut length when the adjuster handle is moved in a forward direction along the longitudinal axis. Therefore, the linkage member is useful for preventing unintentional excess cut of the hairs when the hair clipper is advanced toward the top of the head while gradually decreasing the cut length. However, since the movable blade is urged against the stationary blade by a torsion spring in order to give between the blades a suitable spring bias necessary for causing a hair shearing reciprocating motion of the movable blade on the stationary blade, a relatively large manipulation force is required to slide the adjuster handle and therefore the movable blade against a friction between the blades when adjusting the cut length of the hairs.

In addition, the adjuster handle has a latch means capable of stably holding a shearing position of the movable blade relative to the stationary blade during the shearing operation. The latch means includes a release knob projecting on a portion of the adjuster handle to be accessible by a finger of an operator manipulating the handle. The release knob is provided to unlatch the adjustor handle upon being pressed to thereby permit a sliding movement of the handle for varying the cut length. Eventually, the operator is required to press the release knob for sliding the adjuster handle besides the above described manipulation force. This is inconvenient and is therefore a cause of accumulating fatigue of a wrist or fingers of the operator when shearing the hairs while varying the cut length continuously and manually. Additionally, it may be expected that such linkage member and latch means create difficulties because of necessary complex structures.

SUMMARY OF THE INVENTION

The above problem and insufficiency have been eliminated in an improved hair clipper of the present invention. The hair clipper in accordance with the present invention has a cutter head at the front end of a housing thereof. The cuter head comprises a toothed stationary blade and a toothed movable blade reciprocating on the stationary blade in a hair shearing engagement between individual toothed edges thereof. The toothed edge of the stationary blade is tapered to have a thickness narrower toward its leading edge in an edgewise direction generally perpendicular to the reciprocating motion of the movable blade to define on the surface opposite of the movable blade a skin engaging surface inclined with respect to a cutting plane defined between the stationary and movable blades. In addition, one of the stationary and movable blades is slidable in the edgewise direction for varying a cut length of hairs to be sheared between the toothed edges of the stationary and movable blades. In the hair clipper explained below, the movable blade is slidable in the edgewise direction on the stationary blade. An adjuster handle which is slidably fitted to a surface of the housing is interlocked with the movable blade through a linkage element in such a manner that the movable blade is moved in the edgewise direction by rotating the adjuster handle about the longitudinal axis of the housing. The linkage element has a forward end at which the linkage element is coupled with the movable blade, and a rearward end with a projection for engaging with a groove formed in the inner surface of the adjuster handle. The groove is formed to have a shape like a spiral extending circumferentially and longitudinally in the inner surface, and has a front open end for guiding the projection into the groove, a rear stop end, and a plurality of slope edges alternated by level edges over the length thereof for sliding contact with the projection. When the adjuster handle is rotated about the longitudinal axis of the housing, the projection is moved in a stepwise manner from one level edge to another level edge through the slope edges within the groove. In synchronism with the rotational movement of the adjuster handle, the movable blade is moved along the longitudinal axis to increase and reduce the cut length of hairs. On the other hand, the projection is stably kept at the level edge for maintaining the movable blade at a shearing position with a desired cut length of hairs. By the provision of such groove and projection, it is readily possible to keep the adjuster handle at any desired position for shearing the hairs to the desired cut length, yet allowing the handle to move only with a slight manipulation force.

Accordingly, it is a primary object of the present invention to provide an improved hair clipper which is capable of facilitating to cut hairs to any desired cut length without causing uneven hair cuts with a minimum manipulation force of adjusting the cut length.

The movable blade is urged against the stationary blade by a spring in order to give between the blades a suitable spring bias necessary for causing a hair shearing reciprocating motion of the movable blade on the stationary blade. The movable blade also receives a rearward force by the spring in a direction of reducing the cut length. Therefore, the movable blade is readily moved rearwardly by rotating the adjuster handle with the slight manipulation force. However, it is required that the adjuster handle is rotated to move the movable blade forwardly against the rearward force with a considerable manipulation force. In a preferred embodiment of the present invention, the rearward force is reduced by a counter spring, so that the movable blade can be readily moved by rotating the adjuster handle with the slight manipulation force.

By the way, since a kinetic friction coefficient between the movable and stationary blades is usually smaller than a static friction coefficient therebetween, it is preferred that the movable blade is moved to vary the cut length of hairs during the reciprocating motion of the movable blade. Therefore, in another preferred embodiment of the present invention, a switch for turning on and off the reciprocating motion of the movable blade is interlocked with the adjuster handle in such a manner that the movable blade can be moved by rotating the adjuster handle only after the switch is turned on. More preferably, the adjuster handle has a switch capability, that is, the reciprocating motion of the movable blade is turned on and off at opposite ends of the groove of the adjuster handle.

These and still other objects and advantageous features of the present invention will become more apparent from the following description of the preferred embodiment when taken in conjunction with the attached drawings.

DETAILED DESCRIPTION OF THE EMBODIMENT

A hair clipper of a preferred embodiment of the present invention is described in detail below referring to drawings of FIGS. 1 to 13.

Figure 1:
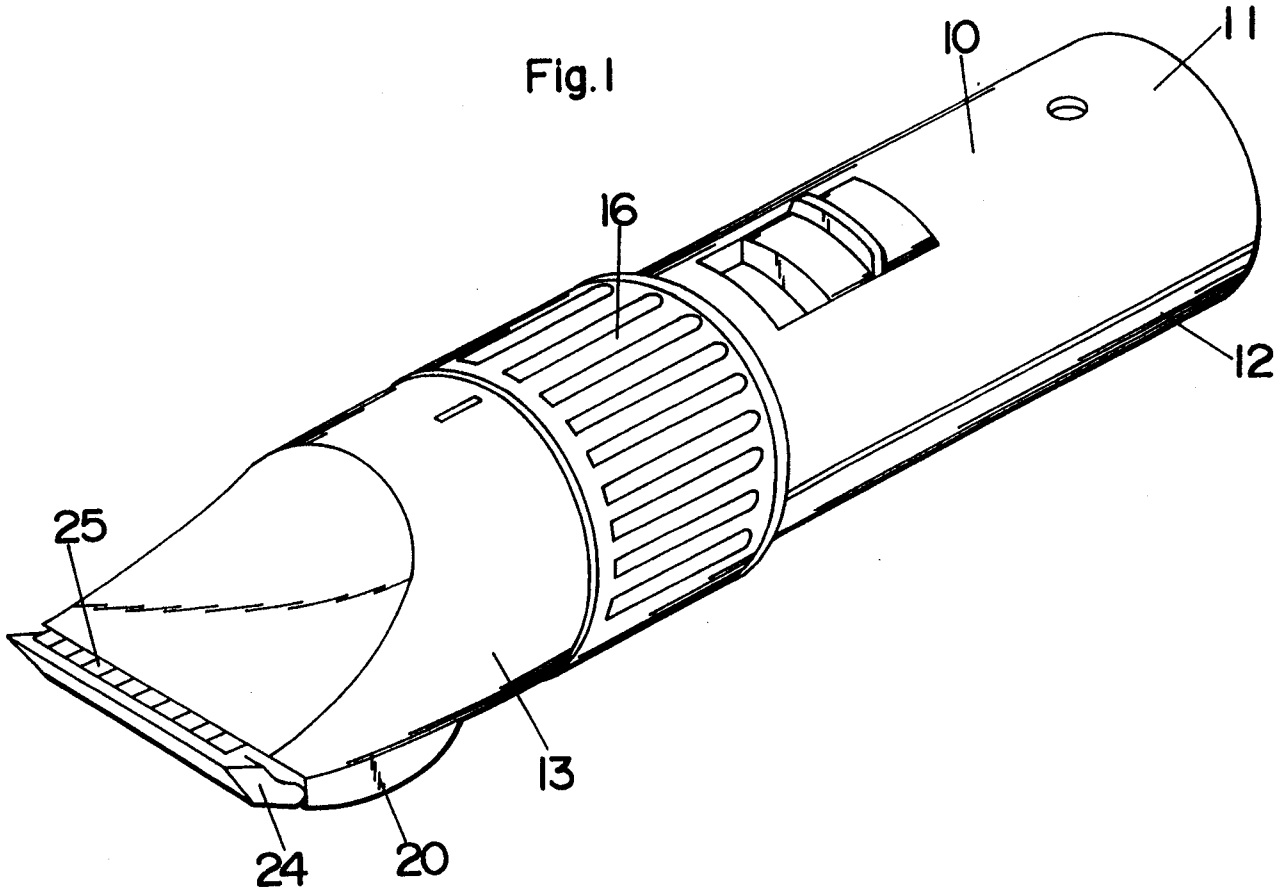
FIG. 1 is an isometric view of a hair clipper in accordance with a preferred embodiment of the present invention.
Figure 2:
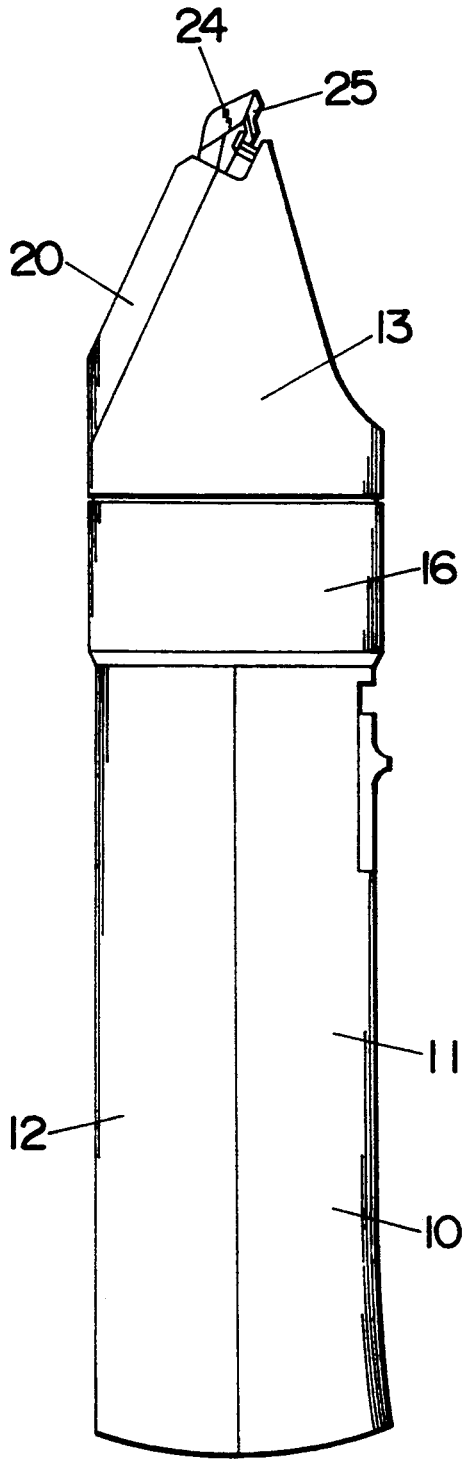
FIG. 2 is a side view of the hair clipper.
Figure 3:
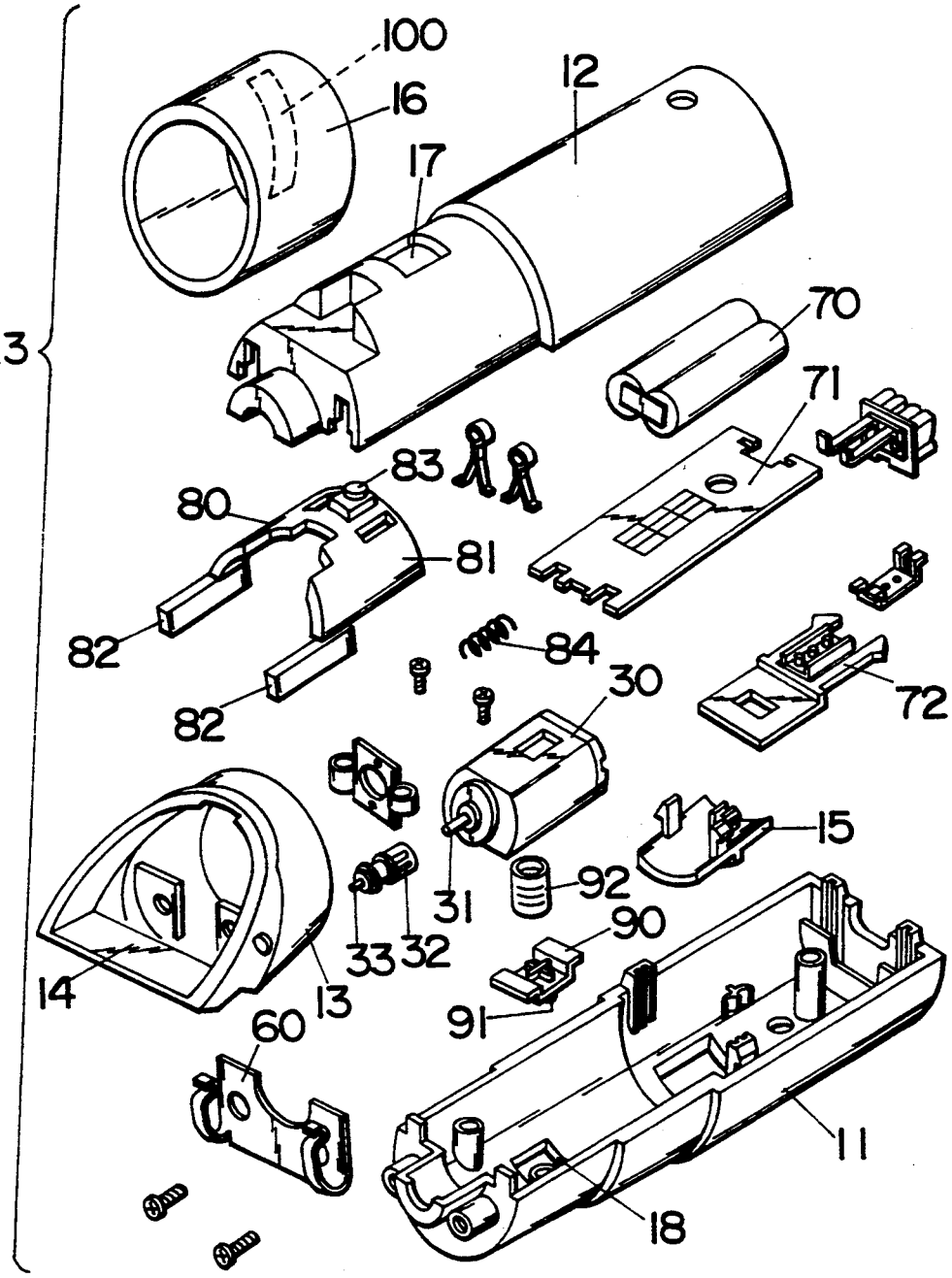
FIG. 3 is an exploded isometric view of the hair clipper with a cutter head removed therefrom.
Figure 4:
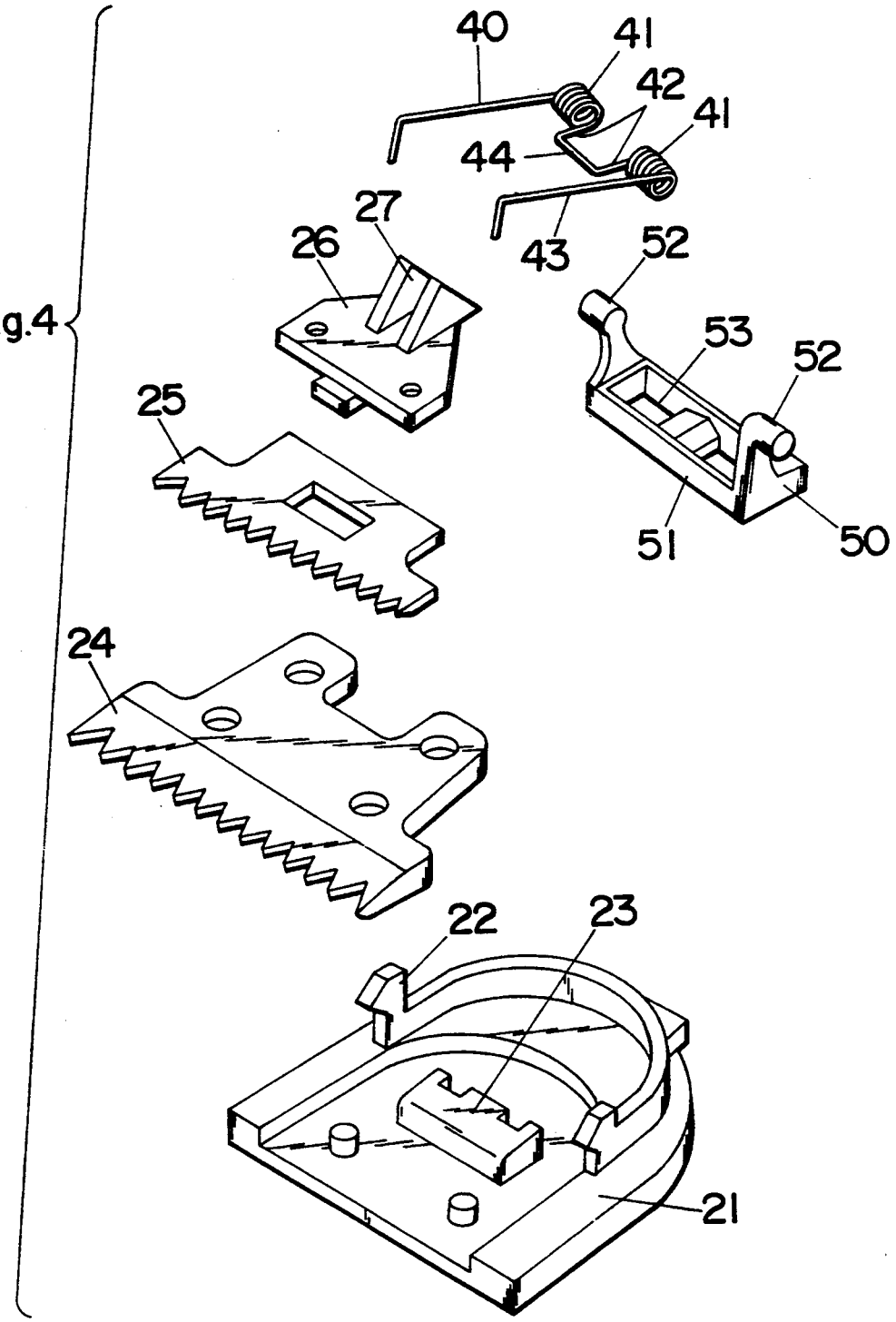
FIG. 4 is an exploded isometric view of the cutting head.
Figure 5:
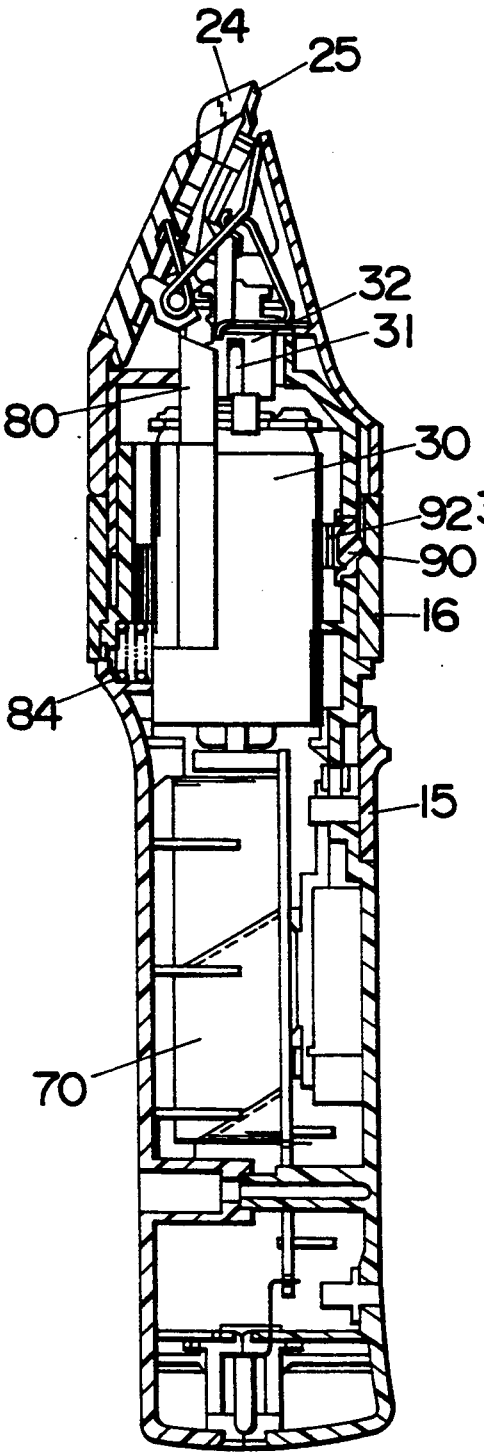
FIG. 5 is a side sectional view of the hair clipper.
Figure 6:
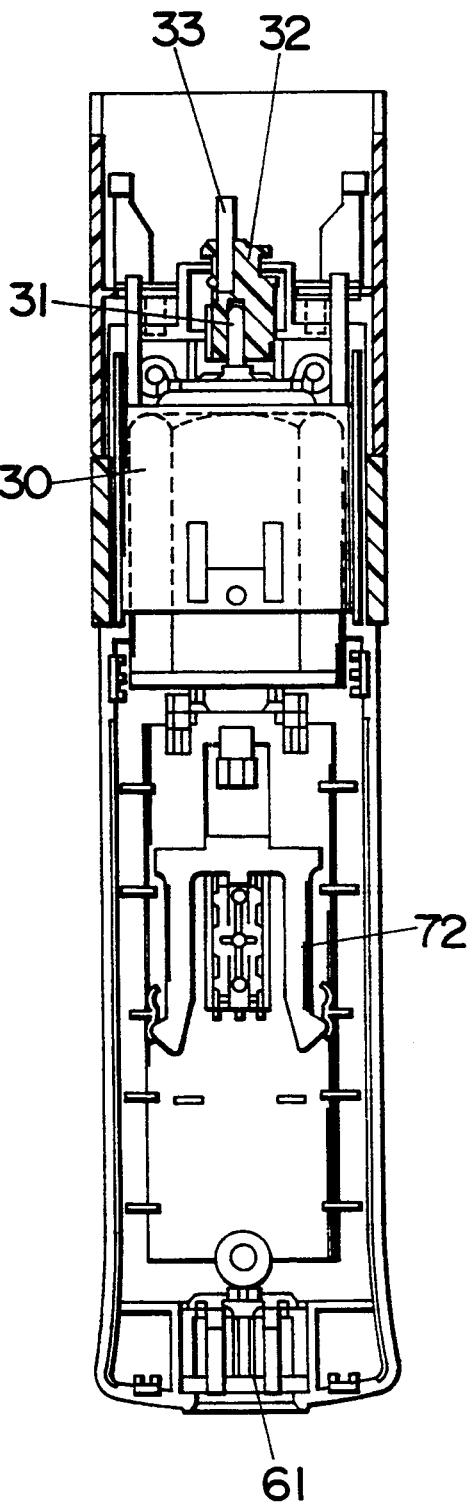
FIG. 6 is a front sectional view of the hair clipper with the cutter head removed therefrom.

Numeral 10 designates a cylindrical tubular grip housing consisting of upper and lower casings 11 and 12, and carrying a cutter head casing 13 at its front end. Numeral 20 designates a cutter head having a base plate 21 carrying a stationary blade 24 and a movable blade 25 which define therebetween a cutting plane inclined with respect to a longitudinal axis of the housing 10. As shown in FIGS. 4 and 5, the stationary blade 24 has a toothed edge which is tapered to define on its lower surface a skin engaging surface inclined with respect to the cutting plane for facing engagement with the scalp of the head. The movable blade 25 is fixed to a drive member 26, and is slidable along the toothed edge of the stationary blade 24 for shearing engagement between toothed edges of the stationary and movable blades 24 and 25 and also slidable in an edgewise direction for varying a cut length of hairs while keeping the shearing engagement. It is not concerned that the stationary blade 24 is slidable on the movable blade 25 in the edgewise direction. The cutter head 20 is fitted to an opening 14 of the cutter head casing 13 in such a manner that the cutter head 20 can be detached from the opening 14 for cleaning purpose by disengaging hooks 22 extending from the base plate 21 from a holder 60 attached to the cutter head casing 13.

Numeral 30 designates a motor incorporated within housing 10 behind the cutter head 20 to have its output shaft 31 connected to a rotary cam 32 with an eccentric pin 33. The eccentric pin 33 extends into a cam slot 27 of the drive member 26 so as to translate the rotary motion of the eccentric pin 33 into a reciprocating motion of the drive member 26 and the movable blade 25 in a direction transverse to the axis of the eccentric pin 33. Thus, the movable blade 25 is driven by the motor 30 to reciprocate on the stationary blade 24 for shearing the hairs therebetween. Numeral 70 designates rechargeable batteries for driving the motor 30 disposed on a lower surface of a battery holder 71 in the rear half of the housing 10. An electronic components forming motor driving and battery charging circuits are mounted on an upper surface of the battery holder 71. An electrical switch 72 is formed adjacent to the battery holder 71 for connecting and disconnecting the motor 30 to and from the batteries 70 in response to a sliding movement of a switch handle 15 on one side of the housing 10. Numeral 61 is a socket formed in the rear end of the housing 10 for electrical connection with a plug at one end of a power cord. The battery holder 71 mounting the rechargeable batteries 70 and the associated electrical parts can be assembled into the housing 10 as one unitary structure.

Numeral 80 designates a linkage member having a generally U-shaped body 81, a pair of plungers 82 extending forwardly from both sides of the U-shaped body 81, and a first boss 83 projecting upwardly at the top of the U-shaped body 81. The free ends of the plungers 82 are abutted to a pair of actuator levers 52 of a spring holder 50 at the rear end of the cutter head 20 in such a way as to shift the movable blade 25 forwardly to an extended position of FIG. 9 and rearwardly to a retracted position of FIG. 10 as the linkage member 80 moves forwardly and rearwardly, respectively. The spring holder 50 is provided to support a torsion spring 40 having a pair of coiled portions 41, first and second segments 42 and 43 extending from each coiled portion 41, and a joint segment 44 extending between the first segments 42. The spring holder 50 has a rod section 51 and the pair of actuator levers 52 extending radially from the opposite ends of the rod section 51. The rod section 51 is provided with recesses 53 constraining therein the coiled portions 41 of the torsion spring 40 so that the first and second segments 42 and 43 extend forwardly from the spring holder 50. The spring holder 50 is pivotally supported to the base plate 21 of the cutter head 20 at the opposite ends of the rod section 51. A pivot axis of the rod section 51 offsets forwardly from a center axis of the coiled portions 41 such that the spring holder 50 can pivot together with the coiled portions 41 about the pivot axis of the rod section. The joint segment 44 between the coiled portions 41 is engaged with a stopper 22 of the base plate 21 in such a manner as to compress the torsion spring 40 and therefore bias the second segments 43 in a direction of liberating the compression. Each end of the second segments 43 is connected with the drive member 26. Therefore, the movable blade 25 fixed to the drive member 26 is urged against the stationary blade 24 by the second segments 43 to obtain a suitable spring bias between the blades during the reciprocating motion of the movable blade 25. At the same time, the torsion spring 40 gives a bias to pivot the spring holder 50 in the clockwise direction about the pivot axis until the bottom of the spring holder 50 abuts against the base plate 21. At this position of the spring holder 50, the second segments 43 pull rearwardly the drive member 26 and the movable blade 25 to the retracted position of FIG. 10 to define a maximum height H1 from the skin engaging surface of the stationary blade 24 to the toothed edge of the movable blade 25. Therefore, in case of cutting the hairs with the hair clipper with the maximum height H1, the cut length of hairs to be sheared between the stationary and movable blades 24 and 25 is minimized. In other words, when the hair clipper with the retracted position is advanced toward the top of the head while contacting the skin engaging surface of the stationary blade 24 to the scalp of the head, short hairs having the length substantially equal to the maximum height H1 are left on the head.

By the way, since the movable blade 25 and the drive member 26 receive the bias resulting from the torsion spring 40, the movable blade 25 can be readily moved toward the retracted position by pulling the linkage member 80 rearwardly with a slight manipulation force. On the contrary, when the movable blade 25 is moved toward the extended position, it is required that the linkage member 80 is pushed forwardly against the bias with a considerable manipulation force. For avoiding this inconvenience, the linkage member 80 is urged forwardly by a counter spring 84 which counteract the torsion spring 40 so as to reduce a required force of pushing the actuator levers 52 in the direction of shifting the movable blade 25 toward its extended position.

Figure 8:
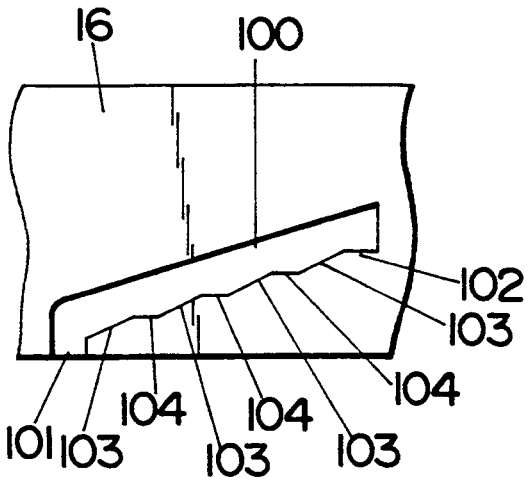
FIG. 8 is a groove formed in the range I—I in FIG. 7A of the inner surface of the adjuster handle.

Numeral 16 designates a cut length adjuster handle having a shape like a ring which is rotatively fitted to an outer round surface of the cylindrical housing 10. The adjuster handle 16 is knurled on its outer surface to facilitate manual operation by a finger of the operator. The adjuster handle 16 has a groove 100 extending in its inner surface with a shape like a part of spiral. As shown in FIG. 8, the groove 100 is formed to have a front open end 101 for guiding the first boss 83 into the groove 100, a rear stop end 102, and a plurality of slope edges 103 alternated by level edges 104 over the length thereof for sliding contact with the first boss 83. The first boss 83 of the linkage member 80 is engaged with the groove 100 of the adjuster handle 16 through a rectangular hole 17 of the housing 10. When the adjuster handle 16 is rotated about the longitudinal axis of the housing 10, the first boss 83 is moved along the groove 100 in a stepwise manner from one level edge 104 to another level edge 104 through the slope edges 103, so that the linkage member 80 is moved forwardly or rearwardly along the longitudinal axis. For example, as the adjuster handle 16 is rotated to shift the linkage member 80 forwardly from the position of FIG. 10, the plungers 82 push the actuator levers 52 forwardly so as to pivot the spring holder 50 about the pivot axis in the counterclockwise direction against the bias of the torsion spring 40, thereby displacing the torsion spring 40 forwardly and therefore the movable blade 25 forwardly toward the extended position of FIG. 9. Though the actuator levers 52 are pushed forwardly against the bias of the torsion spring 40, the bias resulting from the torsion spring 40 is mostly counteracted by the counter spring 84 arranged at the rear end of the linkage member 80, as described above.

Additionally, the groove 100 is preferably formed in the inner surface of the adjuster handle 16 in such a state that when the adjuster handle 16 is rotated over a distance between the adjacent level edges 104, a shift of the movable blade 25 in response with the rotational movement of the adjuster handle 16 is shorter than the distance. In this manner, it is possible to reduce a necessary manipulation force for rotating the adjuster handle 16.

Figure 7A:
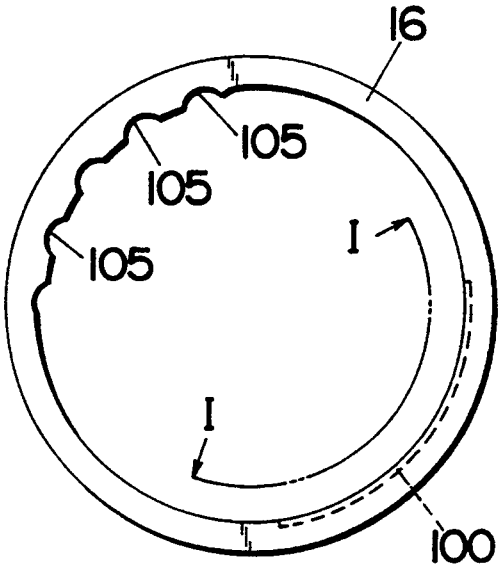
FIGS. 7A and 7B are respectively top and side views of an adjuster handle of the hair clipper.
Figure 7B:
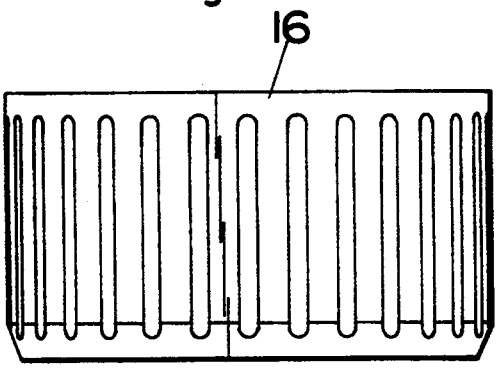

A latch member 90 with a second boss 91 is attached to a square hole 18 which is formed in the opposed surface of the rectangular hole 17 of the housing 10. The latch member 90 is biased upwardly by a spring 92 held between the motor 30 and the latch member 90 for constant meshing engagement of the second boss 91 with the corresponding one of click slots 105 which are located at the opposite inner surface of the groove 100 of the adjuster handle 16 and extend along the longitudinal axis of the housing 10, as shown in FIG. 7A. When the adjuster handle 16 is rotated to set a desired cut length of hairs, the first boss 83 is moved to a level edge 104 within the groove 100, and at the same time the second boss 91 is latched at the click slot 105 corresponding to the level edge 104. Therefore, the adjuster handle 16 can be stably rotated to any desired position and latched thereat without causing an unintentional excess rotation of the adjuster handle 16 during the hair shearing operation. Additionally, it may be effective to give a clicking motion to the adjuster handle 16 by engaging the second boss 91 to the click slot 105 of the adjuster handle 16.

Figure 9:
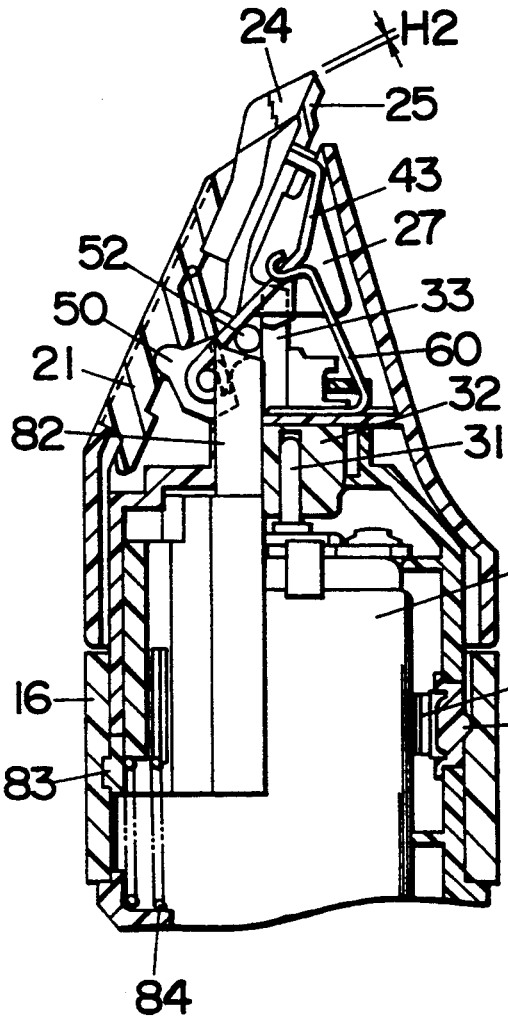
FIG. 9 is a fragmentary sectional view of the hair clipper with the movable blade in an extended position.
Figure 10:
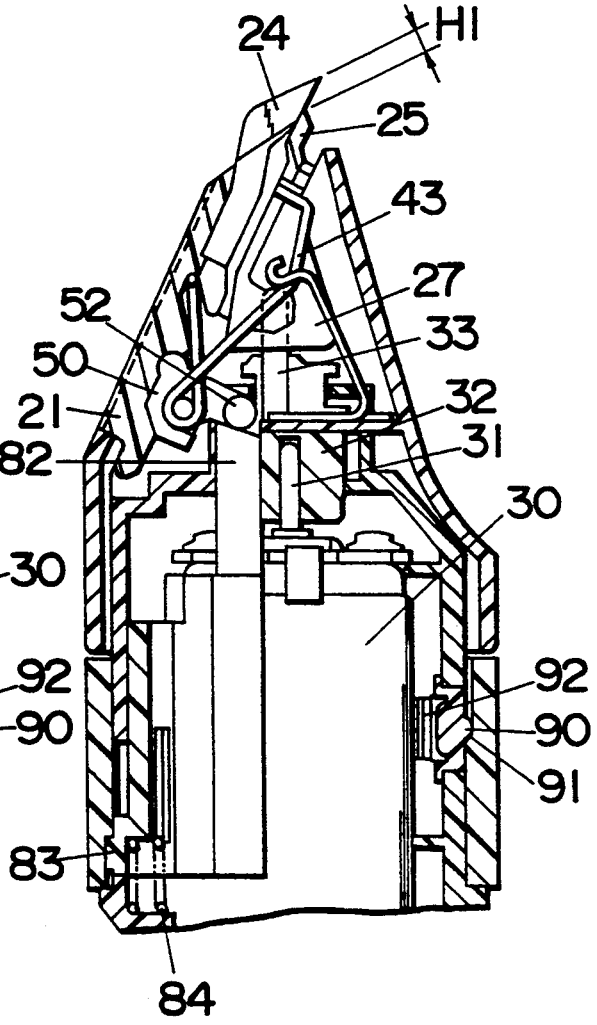
FIG. 10 is a fragmentary sectional view of the hair clipper with the movable blade in a retracted position.

In the hair clipper described above, when the first boss 83 is located in the vicinity of the open end 101 of the groove 100, the movable blade 25 is in the retracted position with the maximum height H1, as shown in FIG. 10. On the other hand, when the first boss 83 is advanced to the stop end 102 by rotating the adjuster handle 16, the movable blade 25 is in the extended position in which the toothed edge of the movable blade 25 is spaced from the skin engaging surface of the stationary blade 24 by a minimum height H2, as shown in FIG. 9. Therefore, it is readily possible to effect a tapered cut on the back and side portions of the head firstly by keeping the adjuster handle 16 at the extended position of the movable blade 25 to make a close cut, and then by rotating the adjuster handle 16 to reduce the cut length in synchronism with the operation of advancing the cutter head 20 upwardly.

Figure 11:
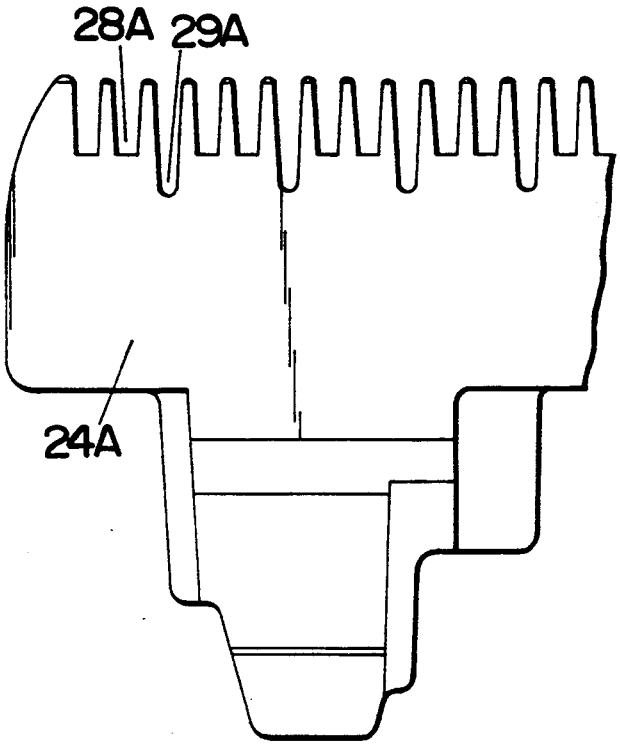
FIG. 11 is a partial plan view of a stationary blade.
Figure 12:
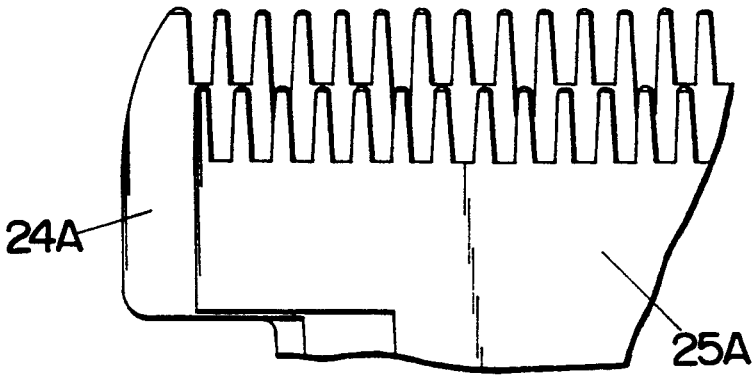
FIG. 12 is a partial plan view of the stationary blade of FIG. 11 and the movable blade in a position to cut hairs only in deep indentations.
Figure 13:
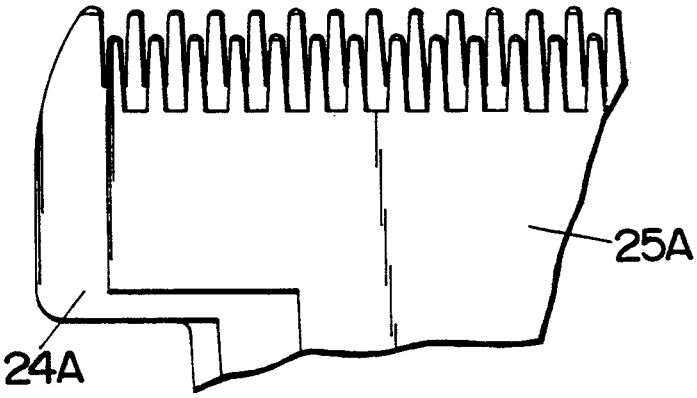
FIG. 13 is a partial plan view of the stationary blade of FIG. 11 and the movable blade in a position to cut the hairs with all indentations.
Figure 14:
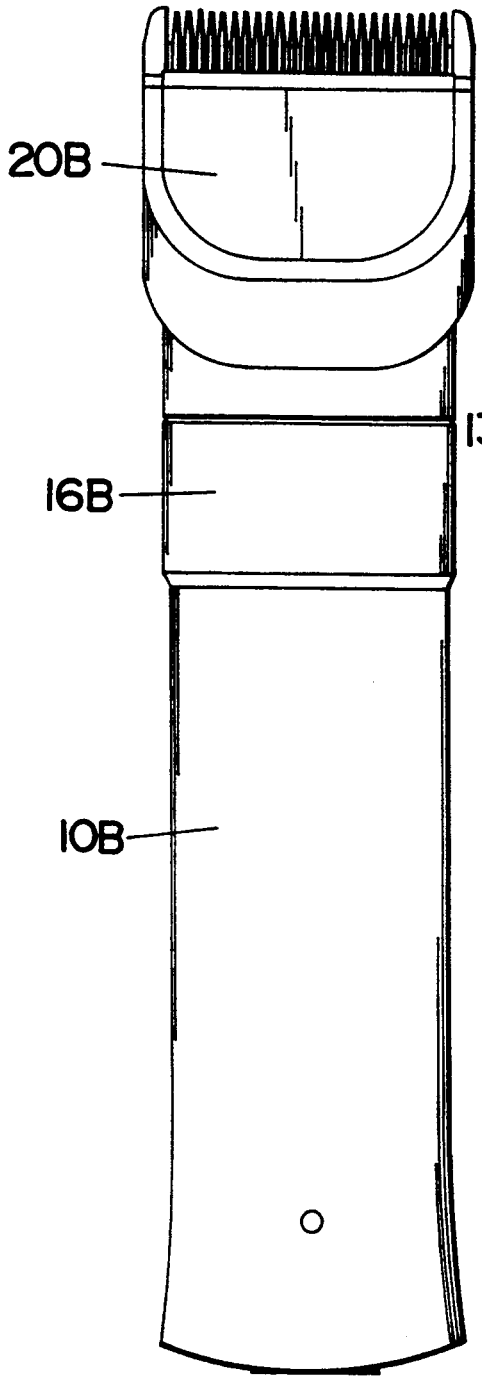
FIG. 14 is a front view of a hair clipper in accordance with a first modification of the above embodiment.
Figure 15:
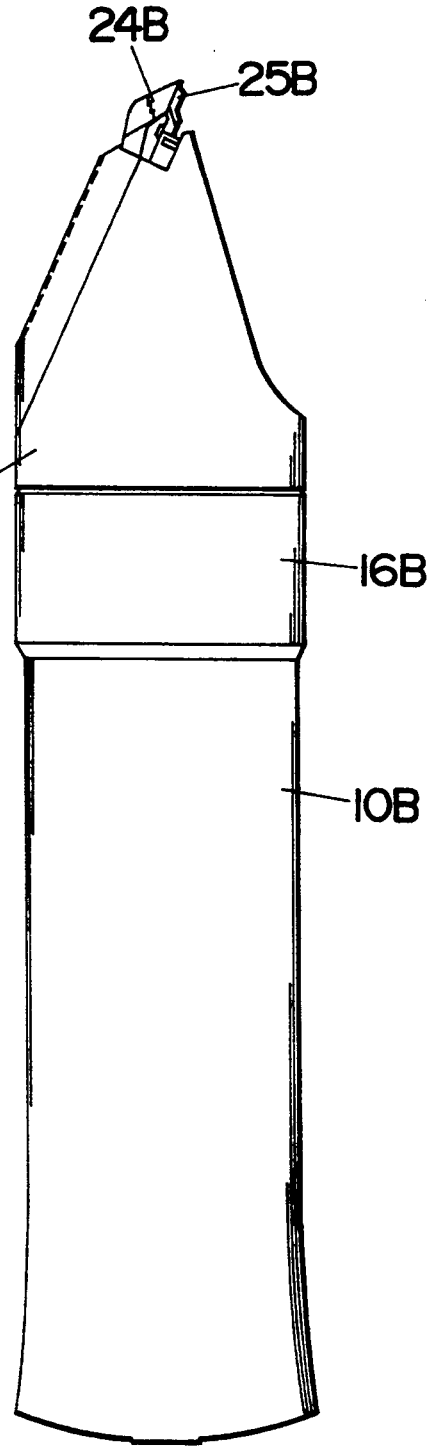
FIG. 15 is a side view of the hair clipper of the first modification.
Figure 17:
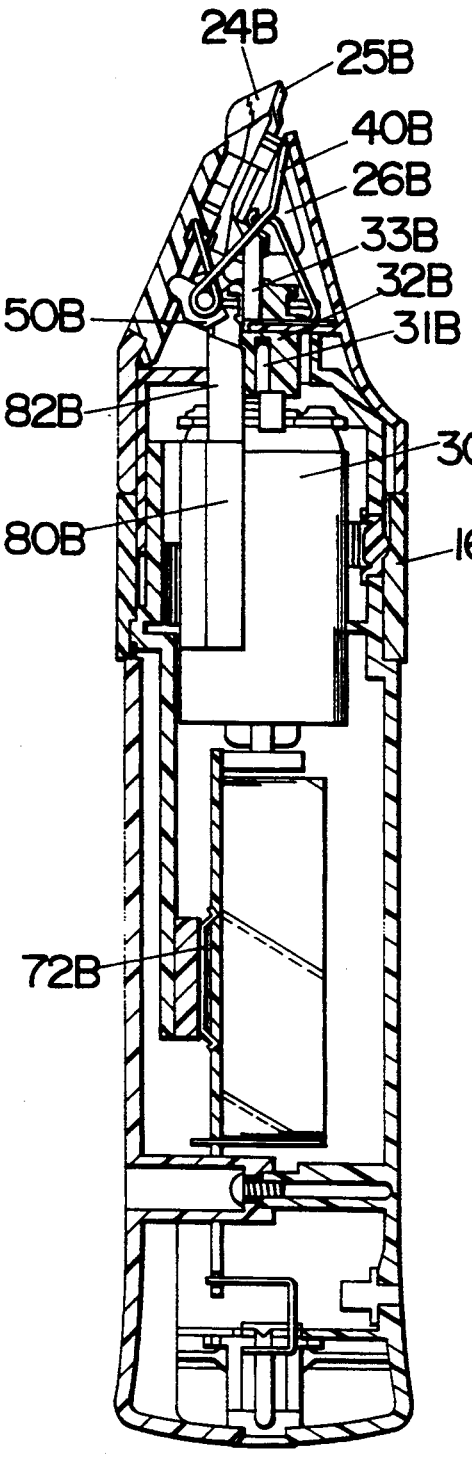
FIG. 17 is a side sectional view of the hair clipper of the first modification.
Figure 16:
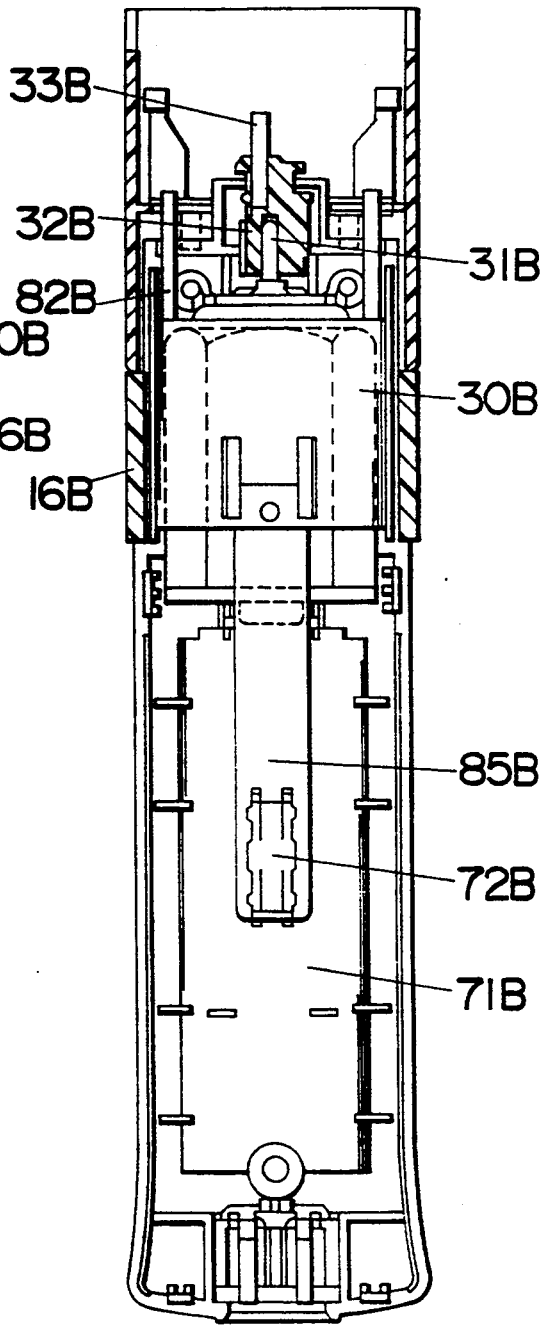
FIG. 16 is a front sectional view of the hair clipper with a cutter head removed therefrom.
Figure 18:
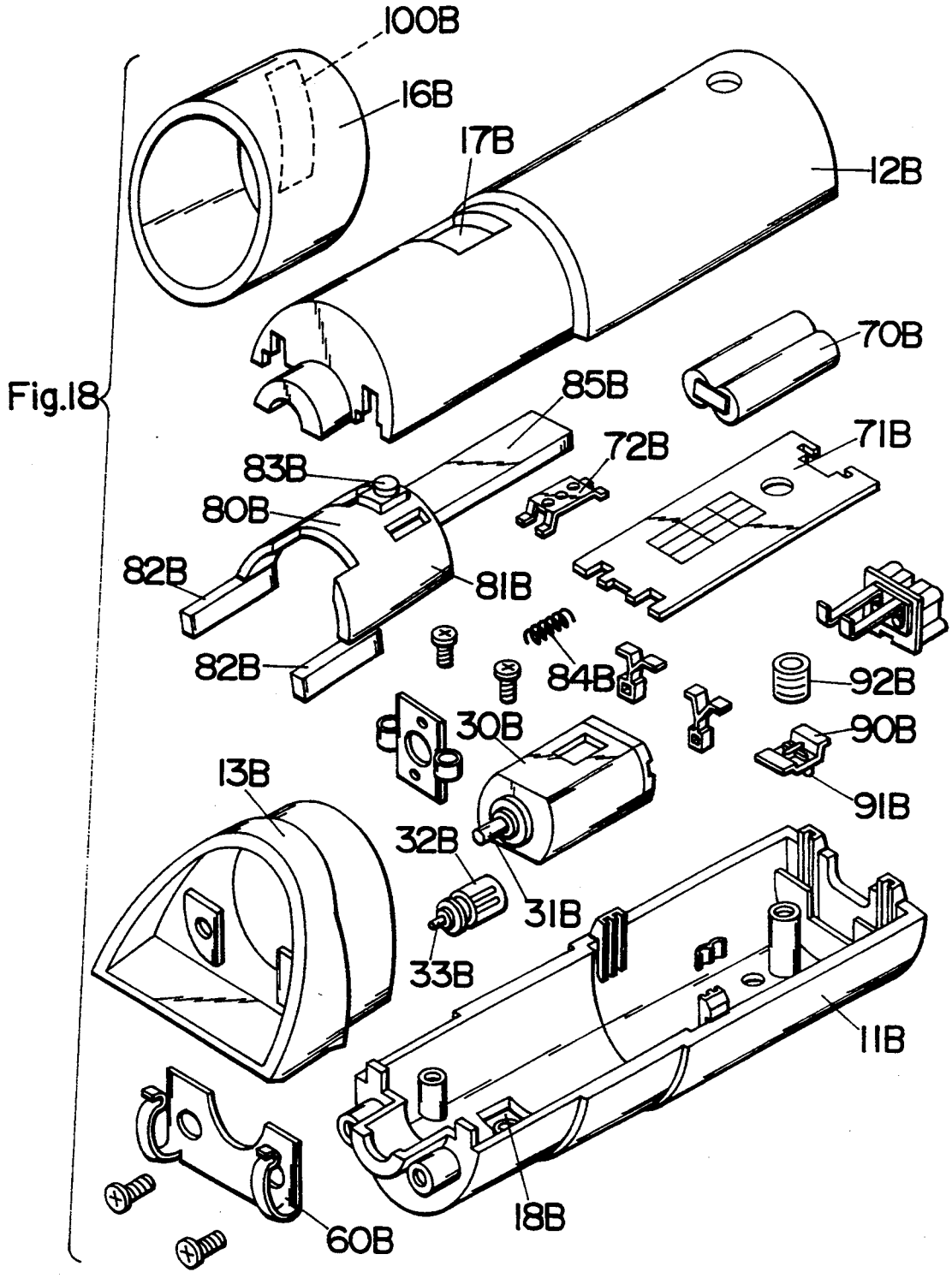
FIG. 18 is an exploded isometric view of the hair clipper of the first modification with the cutter head removed therefrom.

In addition, it is preferred that a stationary blade 24A having shallow and deep indentations 28A and 29A is used instead of the stationary blade 24. The deep indentations 29A are alternated with the shallow indentations 28A, as shown in FIG. 11. In case of cutting hairs with the hair clipper in which a movable blade 25A is adjusted on the stationary blade 24A to the thinning position shown by FIG. 12, the small indentations 28A will act as a comb for keeping most of the hairs away from the movable blade 25A, and thereby the hairs will not all be cut, but will be thinned by shearing between the deep indentations 29A and the toothed edges of the movable blade 25A. In addition, when it is desired to cut all the hairs without thinning it, the movable blade 25A is adjusted on the stationary blade 24A to the cut position shown by FIG. 13.

A hair clipper of a first modification of the above embodiment is explained below referring to drawings of FIGS. 14 to 18. The hair clipper is identical in structure to the above embodiment except that a linkage member 80B and an electrical switch 72B are different from those of the above embodiment. Therefore, no duplicate explanation to common parts and operation are deemed necessary. The hair clipper has the linkage member 80B having a generally U-shaped body 81B, a pair of plungers 82B extending forwardly from both sides of the U-shaped body 81B, a first boss 83B projecting upwardly at the top of the U-shaped body 81B, and an extension 85B extending rearwardly within a cylindrical tubular grip housing 10B for carrying the electrical switch 72B. The linkage member 80B is engaged to an adjuster handle 16B such that the linkage member 80B is moved to shift a movable blade 25B by rotating the adjuster handle 16B in accordance with the same manner as the above embodiment, and also a reciprocating motion of the movable blade 25B is turned on and off at the opposite ends of a groove 100B formed in the inner surface of the adjuster handle 16B. Therefore, the movable blade 25B is moved to vary the cut length only after the reciprocating motion is turned on. It is expected that this manner shows the following advantages. That is, since a kinetic friction coefficient between the movable and stationary blades 25B and 24B is usually smaller than a static friction coefficient therebetween, it is readily possible to shift the movable blade 25B with a slight manipulation force when the reciprocating motion of the movable blade 25B is turned on. Additionally, as the operator is required only to rotate the adjuster handle 16B for initiating the reciprocating motion and then adjusting the cut length, it is very effective for preventing fatigue of a wrist or fingers of the operator when shearing the hairs while varying the cut length continuously and manually.

Figure 19:
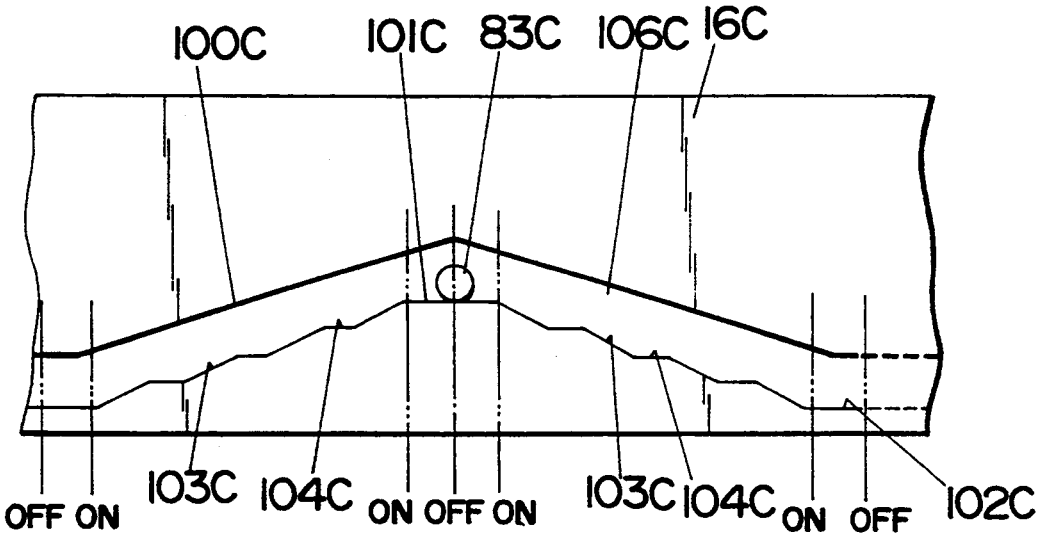
FIG. 19 is a loop groove formed in the inner surface of an adjuster handle in accordance with a second modification of the above embodiment.

In a second modification of the above embodiment, it is preferred that a loop groove 100C with the shape shown by FIG. 19 is formed at the inner surface of an adjuster handle 16C of a hair clipper. The loop groove 100C includes a top rest position 101C, bottom rest position 102C, and inclined runners 106C extending respectively from the top rest position 101C to the bottom rest position 102C. Each inclined runner 106C has a plurality of slope edges 103C alternated by level edges 104C over the length thereof for sliding contact with a first boss 83C of a linkage member. The first boss 83C is engaged to the loop groove 100C such that the reciprocating motion of the movable blade is turned off when the first boss 83C is located at the top and bottom rest positions 101C and 102C, and the reciprocating motion is turned on when the first boss 83C is in the inclined runner 106C. Therefore, the movable blade is moved to vary the cut length of the hairs only after the reciprocating motion is turned on. In this manner, since the adjuster handle 16C can be endlessly rotated about the longitudinal axis of a housing of the hair clipper, the operator is required only to rotate the adjuster handle 16C in one way for initiating on the reciprocating motion and then adjusting the cut length. As a result, it is effective for preventing fatigue of the wrist or the fingers of the operator when shearing the hairs while varying the cut length continuously and manually.

What is claimed is:

1. In a hair clipper comprising:

a housing having a rearward end and an opposed forward end with a cutter head including a stationary blade with a toothed leading edge and a movable blade with a toothed leading edge mounted for reciprocation in a reciprocation direction with said toothed edges overlapping in a hair shearing relation;

said stationary blade having an outer scalp engaging surface and an inner surface facing toward said movable blade;

the outer surface of said stationary blade along its leading edge being included relative to said inner surface so as to produce a shorter length of hairs which is cut when there is a lesser amount of overlap in said hair shearing relationship;

at least one of said stationary blade and said movable blade being a longitudinally movable blade mounted for movement along a longitudinal axis extending in a direction generally perpendicular to said reciprocation direction so as to adjust a cut length of hairs sheared between said blades;

characterized in that an adjustor handle is mounted on said housing for rotational movement about said longitudinal axis, and that linkage means is disposed between said longitudinally movable blade and said adjustor handle for moving said longitudinally movable blade to increase and decrease said length of hairs which is cut when said adjustor handle is rotated about said longitudinal axis;

said linkage means comprising a linkage element extending along said longitudinal axis to have a first end and a second end;

said linkage element coupled at said first end to said longitudinally movable blade to be movable together therewith along said longitudinal axis, said linkage element formed at said second end with a protection for engagement into a corresponding groove formed in said adjustor handle;

said groove extending in an interior surface of said adjustor handle in an inclined manner with respect to a circumferential direction to have front and rear ends spaced circumferentially and longitudinally, said groove formed along its length with a plurality of Slope edges alternated by level edges for sliding contact with said projection, said level edges running in a direction perpendicular to said longitudinal axis such that said longitudinally movable blade is moved longitudinally in a stepwise manner upon rotation of said adjustor handle and such that said longitudinally movable blade is kept at predetermined longitudinal positions while said projection is in contact with said level edges.

2. The hair clipper as set forth in claim 1, wherein said longitudinally movable blade is biased rearward by spring means together with said linkage means in the direction of the rearward end of said housing, said linkage means being coupled to counter spring means which reduces the rearward bias by said spring means so as to lessen an operation force required to move said longitudinally movable blade in the direction of the opposed forward end of said housing.

3. The hair clipper as set forth in claim 1, wherein spring means is provided to urge said movable blade against said stationary blade to give a suitable contacting pressure therebetween, and wherein power switch means for turning on and off the reciprocation of said movable blade is interlocked with said adjustor handle in such a manner that said longitudinally movable blade is moved longitudinally by said adjustor handle only after said power switch means is turned on to initiate the reciprocation of said movable blade.

4. The hair clipper as set forth in claim 3, wherein said power switch means is caused to turn on and off at opposite ends of a range over which said longitudinally movable blade is allowed to move along said longitudinal axis.

5. The hair clipper as set forth in claim 1, wherein said linkage means comprises a linkage element extending along said longitudinal axis to have a forward end and a rearward end, said linkage element coupled at said forward end to said longitudinally movable blade to be movable together therewith along said longitudinal axis, said linkage element formed at said rearward end with a projection for engagement into a corresponding groove formed in said adjustor handle, said groove extending in an interior surface of said adjustor handle and composed first and second runners which are inclined oppositely with respect to said longitudinal axis to have respectively front and rear ends spaced circumferentially and longitudinally, said first and second runners being communicated at said front ends and rear ends, respectively.

6. The hair clipper as set forth in claim 1, wherein said movable blade is urged against said stationary blade by a spring means to obtain a suitable bias between said movable and stationary blades during the reciprocation of said movable blade, and said longitudinally movable blade is biased rearward by said spring means together with said linkage means in the direction of the rearward end of said housing.

* * * * *